US006623160B2

(12) United States Patent
McCarthy, Jr.

(10) Patent No.: US 6,623,160 B2
(45) Date of Patent: Sep. 23, 2003

(54) METHOD AND SYSTEM FOR COOLING HEAT-GENERATING COMPONENT IN A CLOSED-LOOP SYSTEM

(76) Inventor: Joseph H. McCarthy, Jr., 657 Plantation La., Dayton, OH (US) 45419

( * ) Notice: Subject to any disclaimer, the term of this patent is extended or adjusted under 35 U.S.C. 154(b) by 79 days.

(21) Appl. No.: 09/745,588

(22) Filed: Dec. 21, 2000

(65) Prior Publication Data

US 2002/0118794 A1 Aug. 29, 2002

(51) Int. Cl.[7] ..... H01J 35/10

(52) U.S. Cl. ..... 378/200; 378/130; 62/259.2

(58) Field of Search ..... 378/130, 141, 378/199, 200; 62/165, 259.2

(56) References Cited

U.S. PATENT DOCUMENTS

| | | | | |
|---|---|---|---|---|
| 2,265,108 A | | 12/1941 | Berman | |
| 3,584,440 A | | 6/1971 | Vigil | |
| 4,019,983 A | | 4/1977 | Mandt | |
| 4,136,565 A | | 1/1979 | Migrin et al. | |
| 4,250,715 A | | 2/1981 | Ratliff | |
| 4,282,172 A | | 8/1981 | McNight | |
| 4,308,835 A | | 1/1982 | Abbey | |
| 4,367,194 A | | 1/1983 | Schenewerk et al. | |
| 4,387,685 A | | 6/1983 | Abbey | |
| 4,471,907 A | | 9/1984 | Gerstmann | |
| 4,739,153 A | | 4/1988 | Rendel et al. | |
| 4,767,961 A | * | 8/1988 | Koller et al. | 313/12 |
| 4,927,337 A | | 5/1990 | Lustwerk | |
| 4,954,321 A | | 9/1990 | Jensen | |
| 5,043,104 A | | 8/1991 | Stirling | |
| 5,085,809 A | | 2/1992 | Stirling | |
| 5,220,940 A | | 6/1993 | Palmer | |
| 5,410,991 A | | 5/1995 | Beaudry et al. | |

FOREIGN PATENT DOCUMENTS

| | | |
|---|---|---|
| JP | 4248414 | 9/1992 |
| WO | WO 99/31441 | 6/1999 |

OTHER PUBLICATIONS

"W.E. Anderson Duotech Pressure Switches/Flotech Pressure Switches/Midwest Sight Flow Indicators/Conductivity Controls Shoe Testers," 6/97, Bulletin J–20, Dwyer Instruments, Inc., Michigan City, IN USA.

"QuikPiks Gems Stock Products Catalog," pp. 32–33, Gems Sensors Catalog No. 600, Gems Sensors, Inc., Plainville, CT USA.

"Lytron 1997 Catalog Total Thermal Solutions," pp. 12–15 and 26–29, 1997, Lytron, Inc., Woburn, MA USA.

"Product Guide," pp. 1 and 14, 2/97, Comair Rotron, San Ysidro, CA USA.

"The Heart of the System Global Tube & Detector, Electric Avenue Manufacuring Operations," GE Handout, pp. 1–9.

Toboldt, William, "Chapter 15 Engine Cooling Systems," Automotive Encyclopedia, 1995, pp. 189–207, Goodheart Willcox Co.

(List continued on next page.)

*Primary Examiner*—Drew A. Dunn
*Assistant Examiner*—Allen C. Ho
(74) *Attorney, Agent, or Firm*—Jacox Meckstroth & Jenkins

(57) ABSTRACT

A system and method for improving cooling of a heat-generating component in a closed-loop cooling system is shown. The system comprises a venturi having a throat which is coupled to an expansion tank that is exposed to atmospheric pressure in the embodiment being described. The venturi, when used with a pressure switch, can operate to determine a flow rate which can be used to generate a signal which in turn is used to activate or deactivate one or more of the components, such as the heat-generating component, in the system. Advantageously, the design of the embodiment described has a convenient system which utilizes a pressure switch, thereby eliminating the need for a differential pressure switch of the type used in the past.

50 Claims, 5 Drawing Sheets

U.S. PATENT DOCUMENTS 5,509,463 A 4/1996 Callaway et al.
5,666,910 A * 9/1997 George, II et al. ..... 122/40
5,676,173 A 10/1997 Conrad et al.
5,732,123 A * 3/1998 Peralta et al. ..... 378/199
5,880,378 A 3/1999 Behring, II
5,890,880 A 4/1999 Lustwerk
5,934,328 A 8/1999 Conrad et al.

* cited by examiner 10
38
44
42a
42b
42
45
46
49
22
22a
28
32
40
34
26
36
30
50
ECU
18
16
14
12
20

FIG-5

TABLE IV

| D6 Inch | D11/D6 Inch | D11 Inch | Area Sq Inch | Area Sq Ft | Flow GPM | Flow Cu Ft/Sec | Velocity Ft/Sec | Pressure Rise Ft of Water | Pressure Rise PSIG |
|---|---|---|---|---|---|---|---|---|---|
| 0.5 | 0.322 | 0.161 | 0.020 | 0.0001 | 1 | 0.0022 | 15.76 | 3.86 | 1.68 |
| 0.5 | 0.322 | 0.161 | 0.020 | 0.0001 | 2 | 0.0045 | 31.52 | 15.43 | 6.70 |
| 0.5 | 0.322 | 0.161 | 0.020 | 0.0001 | 3 | 0.0067 | 47.28 | 34.71 | 15.08 |
| 0.5 | 0.322 | 0.161 | 0.020 | 0.0001 | 4 | 0.0089 | 63.04 | 61.71 | 26.80 |
| 0.5 | 0.322 | 0.161 | 0.020 | 0.0001 | 5 | 0.0111 | 78.80 | 96.42 | 41.88 |
| 0.5 | 0.322 | 0.161 | 0.020 | 0.0001 | 6 | 0.0134 | 94.56 | 138.85 | 60.31 |
| 0.5 | 0.375 | 0.1875 | 0.028 | 0.0002 | 1 | 0.0022 | 11.62 | 2.10 | 0.91 |
| 0.5 | 0.375 | 0.1875 | 0.028 | 0.0002 | 2 | 0.0045 | 23.24 | 8.39 | 3.64 |
| 0.5 | 0.375 | 0.1875 | 0.028 | 0.0002 | 3 | 0.0067 | 34.86 | 18.87 | 8.20 |
| 0.5 | 0.375 | 0.1875 | 0.028 | 0.0002 | 4 | 0.0089 | 46.48 | 33.55 | 14.57 |
| 0.5 | 0.375 | 0.1875 | 0.028 | 0.0002 | 5 | 0.0111 | 58.10 | 52.42 | 22.77 |
| 0.5 | 0.375 | 0.1875 | 0.028 | 0.0002 | 6 | 0.0134 | 69.72 | 75.48 | 32.78 |
| 0.5 | 0.375 | 0.1875 | 0.028 | 0.0002 | 7 | 0.0156 | 81.34 | 102.74 | 44.62 |
| 0.5 | 0.402 | 0.201 | 0.032 | 0.0002 | 1 | 0.0022 | 10.11 | 1.59 | 0.69 |
| 0.5 | 0.402 | 0.201 | 0.032 | 0.0002 | 2 | 0.0045 | 20.22 | 6.35 | 2.76 |
| 0.5 | 0.402 | 0.201 | 0.032 | 0.0002 | 3 | 0.0067 | 30.34 | 14.29 | 6.21 |
| 0.5 | 0.402 | 0.201 | 0.032 | 0.0002 | 4 | 0.0089 | 40.45 | 25.40 | 11.03 |
| 0.5 | 0.402 | 0.201 | 0.032 | 0.0002 | 5 | 0.0111 | 50.56 | 39.69 | 17.24 |
| 0.5 | 0.402 | 0.201 | 0.032 | 0.0002 | 6 | 0.0134 | 60.67 | 57.16 | 24.82 |
| 0.5 | 0.402 | 0.201 | 0.032 | 0.0002 | 7 | 0.0156 | 70.78 | 77.80 | 33.79 |
| 1.6 | 0.399 | 0.6381 | 0.320 | 0.0022 | 60 | 0.1337 | 60.20 | 56.27 | 24.44 |

LIQUID-TO-AIR EXCHANGER
102
100
104
106
108
HEAT REJECTION COMPONENT
HEAT REGENERATING COMPONENT
SECONDARY FLUID
VENTURI AND SWITCH
49
PRIMARY FLUID

METHOD AND SYSTEM FOR COOLING HEAT-GENERATING COMPONENT IN A CLOSED-LOOP SYSTEM

BACKGROUND OF THE INVENTION

1. Field of the Invention

This invention relates to a cooling system, and more particularly, it relates to a venturi used in a closed-loop cooling system to facilitate cooling a heat-generating component by raising the pressure of the fluid in the system and, therefore, the boiling point of the fluid, with the increased pressure establishing that there is flow in the closed-loop system.

2. Description of the Prior Art

In many prior art cooling systems, the fluid is absorbing heat from a heat-generating component. The fluid is conveyed to a heat exchanger which dissipates the heat and the fluid is then recirculated to the heat-generating component. The size of the heat exchanger is directly related to the amount of heat dissipation required. For example, in a typical X-ray system, an X-ray tube generates a tremendous amount of heat on the order of 1 KW to about 10 KW. The X-ray tube is typically cooled by a fluid that is pumped to a conventional heat exchanger where it is cooled and then pumped back to the heat-generating component.

In the past, if a flow rate of the fluid fell below a predetermined flow rate, the temperature of the fluid in the system would necessarily increase to the point where the fluid in the system would boil or until a limit control would turn the heat-generating component off. This boiling would sometimes cause cavitation in the pump.

The increase in temperature of the fluid could also result in the heat-generating component not being cooled to the desired level. This could either degrade or completely ruin the performance of the heat-generating component altogether.

In the typical system of the past, a flow switch was used to turn the system off when the flow rate of the fluid became too low. FIG. 6 is a schematic illustration of a venturi which will be used to describe a conventional manner of measuring the flow rate. Referring to FIG. 6, the velocity at point B is higher than at either of sections A, and the pressure (measured by the difference in level in the liquid in the two legs of the U-tube at B) is correspondingly greater.

Since the difference in pressure between B and A depends on the velocity, it must also depend on the quantity of fluid passing through the pipe per unit of time (flow rate in cubic feet/second equals cross-sectional area of pipe in $ft^2 \times$the velocity in ft./second). Consequently, the pressure difference provided a measure for the flow rate. In the gradually tapered portion of the pipe downstream of B, the velocity of the fluid is reduced and the pressure in the pipe restored to the value it had before passing through the construction.

A pressure differential switch would be attached to the throat and an end of the venturi to generate a flow rate measurement. This measurement would then be used to start or shut the heat-generating component down.

In the past, a conventional pressure differential switch measured this pressure difference in order to provide a correlating measurement of the fluid flow rate in the system. The flow rate would then be used to control the operation of the heat-generating component, such as an X-ray tube.

Unfortunately, the pressure differential switch of the type used in these types of cooling systems of the past and described earlier herein are expensive and require additional care when coupling to the venturi. The pressure differential switches of the past were certainly more expensive than a conventional pressure switch which simply monitors a pressure at a given point in a conduit in the closed-loop system.

What is needed, therefore, is a system and method which facilitates using low-cost components, such as a non-differential pressure switch (rather than a differential pressure switch), which also provides a means for increasing pressure in the closed-loop system.

SUMMARY OF THE INVENTION

It is, therefore, a primary object of the invention to provide a system and method for improving cooling of a heat-generating component, such as an X-ray tube in an X-ray system.

Another object of the invention is to provide a closed-loop cooling system which uses a venturi and pressure switch combination, rather than a differential pressure switch, to facilitate controlling cooling of one or more components in the system.

Another object of the invention is to provide a closed-loop system having a venturi whose throat is set at a predetermined pressure, such as atmospheric pressure so that the venturi can provide means for controlling cooling of the heat-generating component in the system.

In one aspect, this invention comprises a method for increasing pressure in a closed-loop system comprising a pump for pumping fluid in the system, a heat-generating component and a heat-rejection component, the method comprising the steps of situating a venturi in series in the closed-loop system and providing a predetermined pressure at a throat of the venturi, using the pump to cause flow in the closed-loop system in order to increase pressure in the system, thereby increasing the boiling point of the fluid, the overall pressure being greater than the predetermined pressure.

In another aspect this invention comprises a cooling system for cooling a component comprising a heat-rejection component coupled to the component, a pump for pumping fluid to the heat-rejection component and the component, a conduit for communicating fluid among the component, the heat-rejection component and the pump, the conduit comprising a venturi having a predetermined pressure applied at a throat of the venturi.

In a yet another aspect, this invention comprises An X-ray system comprising an X-ray apparatus for generating X-rays, the X-ray apparatus comprising an X-ray tube situated in an X-ray tube casing and a cooling system for cooling the X-ray tube, the cooling system comprising a heat-rejection component coupled to the X-ray tube casing, a pump for pumping fluid to the heat-rejection component and the component, a conduit for communicating fluid among the X-ray tube casing, the heat-rejection component and the pump; the conduit comprising a venturi having a predetermined pressure applied at a throat of the venturi.

In yet another aspect, this invention comprises a method for cooling a component situated in a system, the method comprising the steps of providing a conduit coupled to the component, coupling the component casing to a pump for pumping a cooling fluid through the conduit and to a heat-rejection component, increasing a boiling point of the cooling fluid, thereby increasing an operating temperature of the X-ray system.

In still another aspect, this invention comprises a method for cooling a component situated in a system, the said method comprising the steps of providing a conduit coupled to the component, coupling the component casing to a pump for pumping a cooling fluid through the conduit and to a heat-rejection component, increasing a boiling point of the cooling fluid, thereby increasing an operating temperature of the X-ray system.

These and other objects and advantages of the invention will be apparent from the following description, the appended claims, and the accompanying drawings.

BRIEF DESCRIPTION OF ACCOMPANYING DRAWINGS

FIG. 5 is a table representing various measurements relative to a given flow diameter at a particular flow rate.

DETAILED DESCRIPTION OF PREFERRED EMBODIMENTS

Figure 1:
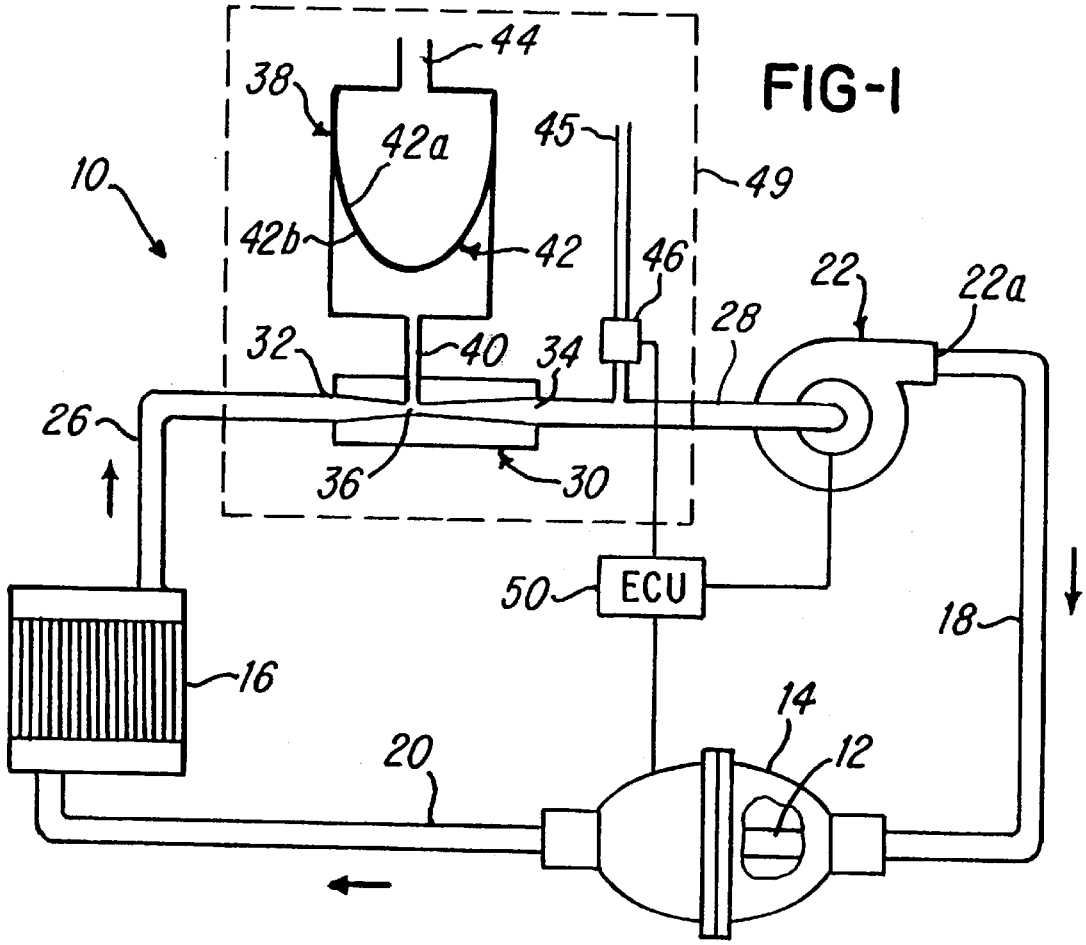
FIG. 1 is a schematic view of a cooling system in accordance with one embodiment of the invention showing a venturi having a throat coupled to an expansion tank or accumulator whose bladder is exposed to atmospheric pressure.

Referring now to FIG. 1, a cooling system 10 is shown for cooling a component 12. While one embodiment of the invention will be described herein relative to a cooling system for cooling the X-ray tube 12 situated inside a housing 14. It should be appreciated that the features of the invention may be used for cooling any heat-generating component in the closed-loop system 10.

As mentioned, the cooling system 10 comprises a heat-generating component, such as the X-ray tube 12, and a heat exchanger or heat-rejection component 16, which in the embodiment being described is a heat exchanger available from Lytron of Woburn, Mass.

The system 10 further comprises a fluid pump 22 which is coupled to housing 14 via conduit 18. In the embodiment being described, the pump 22 pumps fluid, such as a coolant, through the various conduits and components of system 10 in order to cool the components 12. It has been found that one suitable pump 22 is the pump Model No. H0060.2A-11 available from Tark. Inc. of Dayton, Ohio. In the embodiment being described, the pump 22 is capable of pumping on the order of between 0 and 10 gallons per minute, but it should be appreciated that other size pumps may be provided, depending on the cooling requirements, size of the conduits in the system 10 and the like.

In the embodiment being described, the throat 36 of venturi 30 is subject to a predetermined pressure, such as atmospheric pressure. This predetermined pressure is selected to facilitate increasing the fluid pressure in the system 10 which, in turn, facilitates increasing a boiling point of the fluid which has been found to facilitate reducing or preventing cavitation in the pump 22.

Figure 2:
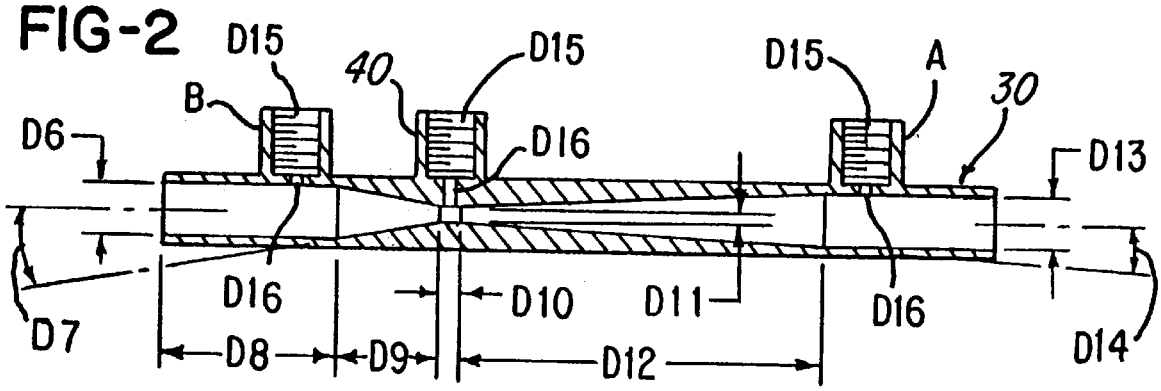
FIG. 2 is a sectional view of the venturi shown in FIG. 1.

The system 10 further comprises a venturi 30 having an inlet end 32, an outlet end 34 and a throat 36. For ease of description, the venturi 30 is shown in FIG. 2 as having downstream port A, upstream port B, and throat port 40 that are described later herein. The venturi 30 is coupled to heat-rejection component 16 via conduit 26 and pump 22 via conduit 28, as illustrated in FIG. 1. In the embodiment being described, the throat 36 of venturi 30 is coupled to an expansion tank or accumulator 38 at an inlet port 40 of the accumulator 38, as shown in FIG. 1. The accumulator 38 comprises a bladder 42 having a first side 42*a* exposed to atmosphere via port 44. A second side 42*b* of bladder 42 is exposed or subject to pressure Pt, which is the pressure at the throat 36 of venturi 30, which is also atmospheric.

An advantage of this invention is that the venturi causes higher pressures and, therefore, a higher operating fluid temperature without boiling. This creates a larger temperature differential that maximizes the heat transfer capabilities of heat exchanger 16. Stated another way, raising a boiling point of the fluid in the system 10 permits higher fluid temperatures, which maximizes the heat exchanging capability of heat exchanger 16. These features of the invention will be explored later herein.

The system 10 further comprises a switch 46 situated adjacent (at port A in FIG. 2) venturi 30 in conduit 28, as illustrated in FIG. 1. In the embodiment shown in FIG. 1, the switch 46 is a non-differential pressure switch 46 that is located downstream of the venturi 30, but upstream of pump 22, but it could be situated upstream of venturi 30 (at port B illustrated in FIG. 2) if desired. As shown in FIG. 1, the switch is open, via throat 45, to atmosphere and measures fluid pressure relative to atmospheric pressure. Therefore, it should be appreciated that because the pressure Pt at the throat 36 is also at atmospheric pressure, a difference in the pressure at throat 36 compared to the pressure sensed by switch 46 can be determined. This differential pressure is directly proportionally related to the flow in the system 10. Consequently, it provides a measurement of a flow rate in the system 10.

If necessary, either port A or port B may be closed after the switch is situated downstream or upstream, respectively, of said venturi 30. It has been found that the use of the pressure switch, rather than a differential pressure switch, is advantageous because of its economical cost and relatively simple design and performance reliability. It should be appreciated that the switch 46 is coupled to an electronic control unit ("ECU") 50. The switch 46 provides a pressure signal corresponding to a flow rate of the fluid in system 10. As mentioned earlier, the switch 46 may be located either upstream or downstream of the venturi 30. This signal is received by ECU 50, which is coupled to pressure switch 46 and component 12, in order to monitor the temperature of the fluid and flow through component 12 in the system 10. Thus, for example, when a flow rate of the fluid in system 10 is below a predetermined rate, such as 5 gpm. In this embodiment, then ECU 50 may respond by turning component 12 off so that it does not overheat.

Thus, the switch 46 cooperates with venturi 30 to provide, in effect, a pressure differential switch or flow switch which may be used by ECU 50 to monitor and control the temperature and flow rate of the fluid in the closed-loop system 10 in order to control the heating and cooling of component 12. It should also be appreciated that the switch 46 may be a conventional pressure switch, available from Whitman of Bristol, Conn.

The expansion tank or accumulator 38, which is maintained at atmospheric pressure, is connected to the throat 36 of venturi 30, with the venturi 30 connected in series with the main circulating loop of the closed-loop system 10. The venturi 30 and switch 46 cooperate to automatically control the pressure and temperature in the circulating system 10 by monitoring the flow of the fluid in the system 10. The pressure differential between the throat 36 and, for example, the inlet end 32 of venturi 30 remains substantially constant, as long as the flow is substantially constant.

Because the pressure Pt at the throat 36 is held at atmospheric pressure, the subsequent pressure at outlet end 34 may be calculated using the formula $(V_t - V_e)^2/2\,g$, where $V_e$ is a velocity of the fluid at, for example, end 34 of venturi 30 and $V_t$ is a velocity of the fluid at the throat 36 of venturi 30.

The ECU 50 may use the determined measurement of flow from switch 46 to cause the component 12 to be turned off or on if the flow rate of the fluid in system 10 is below or above, respectively, a predetermined flow rate. In this regard, switch 46 generates a signal responsive to pressure (and indicative of the flow rate) at end 34. This signal is received by ECU 50, which, in turn, causes the component 12 to be turned off or on as desired. Advantageously, this permits the flow rate of the fluid in the system 10 to be monitored such that if the flow rate decreases, thereby causing the cooling capability of the fluid in the closed-loop system to decrease, then the ECU 50 will respond by shutting the heat-generating component 12 off before it is damaged by excessive heat or before other problems occur resulting from excessive temperatures.

Advantageously, it should be appreciated that the use of the venturi 30 having the throat 36 subject to atmospheric pressure via the expansion tank 38 in combination with the pressure switch 46 provides a convenient and relatively inexpensive way to measure the flow rate of the fluid in the system 10 thereby eliminating the need for a pressure differential switch of the type used in the past. This also provides the ability to monitor the flow rate of the fluid in the closed-loop system 10.

Figure 4:
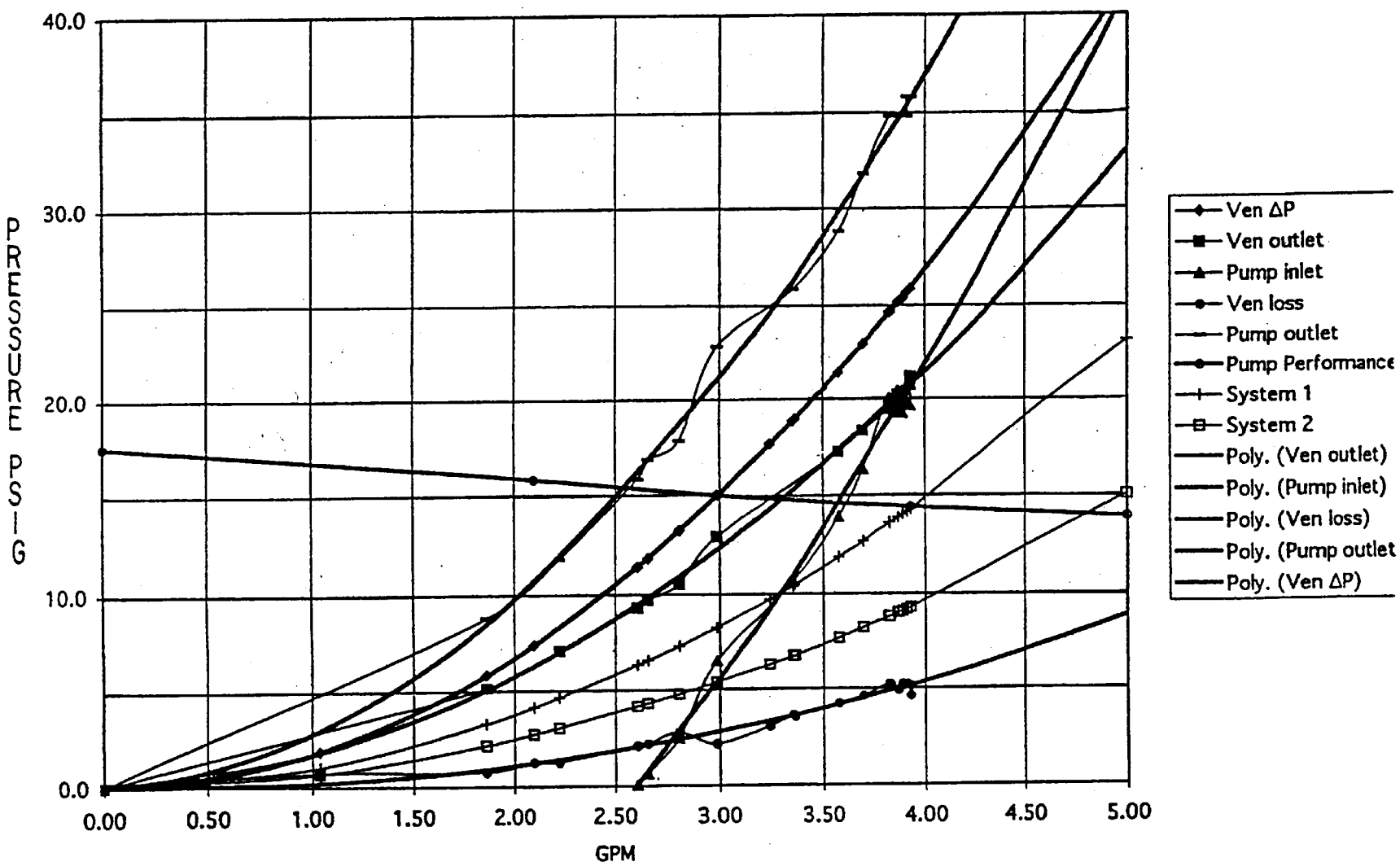
FIG. 4 are plots of the relationship between pressure and flow rate at various points in the system.
Figure 6:
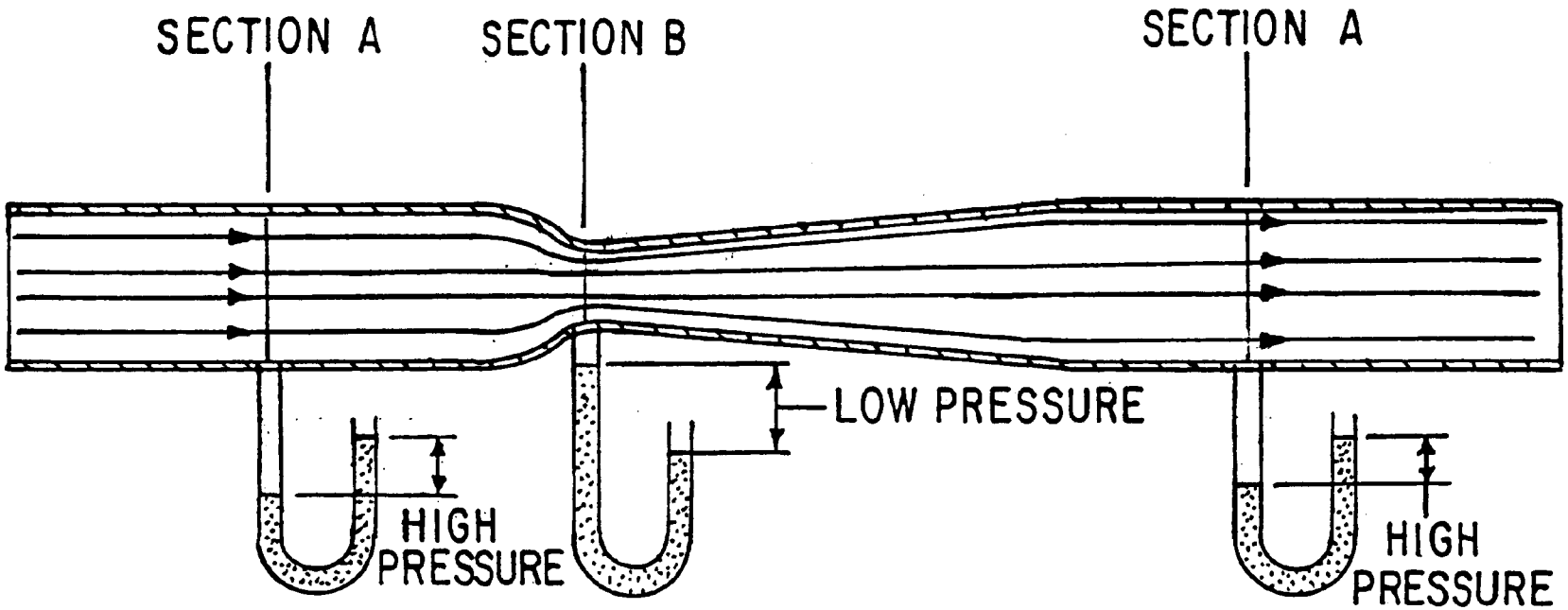
FIG-6 (PRIOR ART)
FIG. 6 is a sectional view of a venturi of the prior art.

FIG. 4 is a diagram illustrating five locations describing various properties of the fluid as it moves through the closed-loop system 10.

Neglecting minor temperature and pressure losses in the conduits 18, 20, 26 and 28. The following Table I gives the relative properties (velocity, gauge pressure, temperature) when a flow rate of the fluid is held constant at four gallons per minute.

TABLE I

| GPM | Location (FIG. 1) | Velocity (fps) | Gage Pressure (psi) | Temperature (F.) |
|---|---|---|---|---|
| 4 | 32 | 8 | 26 | 160 |
| 4 | 36 | 64 | 0 | 160 |
| 4 | 34 | 8 | 24.7 | 160 |
| 4 | 18 | 8 | 40 | 160 |
| 4 | 20 | 8 | 35 | 167 |

The following Table II provides, among other things, different venturi 30 gauge pressures and fluid velocities resulting from flow rates of between zero to 4 gallons per minute in the illustration being described. Note that the pressure at the throat 36 of venturi 30 is always held at atmospheric pressure when the expansion tank 38 is coupled to the throat 36 as illustrated in FIG. 1.

TABLE II

| Location (FIG. 1) Flow rate | 32 Inlet Velocity (ft/sec) | 32 Inlet Pressure (psi) | 36 Throat Velocity (ft/sec) | 362 Throat Pressure (psi) | 34 Outlet Velocity (ft/sec) | 34 Outlet Pressure (psi) |
|---|---|---|---|---|---|---|
| 0 | 0 | 0 | 0 | 0 | 0 | 0 |
| 1 | 2 | 1.7 | 16 | 0 | 2 | 1.6 |
| 2 | 4 | 7 | 32 | 0 | 4 | 6.65 |
| 4 | 8 | 26 | 64 | 0 | 8 | 24.7 |

Note from the Tables I and II that when there is no flow, the fluid pressure throughout the closed-loop system 10 is that of the expansion tank or atmospheric pressure. In the closed-loop system 10, Table I shows the fluid at a minimum pressure at the venturi throat 36 and maximum on a discharge or outlet side 22*a* of pump 22. There is a pressure loss after entering and leaving the heat-generating component 12, such as the X-ray tube, heat exchanger 16 and venturi 30. Velocity is held substantially constant throughout the system 10 because the inner diameter of the conduits 18, 20, 26 and 28 are substantially the same. Fluid velocity changes only when an area of the passage it travels in is either increased or decreased, such as when the fluid is pumped from ends 32 at 34 towards and away from throat 36 of venturi 30.

If the system 10 is assumed to reach a steady state, then a temperature of the fluid in the system 10 will increase from a value before the heat-generating component 12 to a higher value after exiting the heat-generating component 12. The higher temperature fluid will cool back down to the original temperature after exiting the heat exchanger 16, neglecting small temperature changes throughout the conduits 18, 20, 26 and 28 of the system 10.

Figure 3:
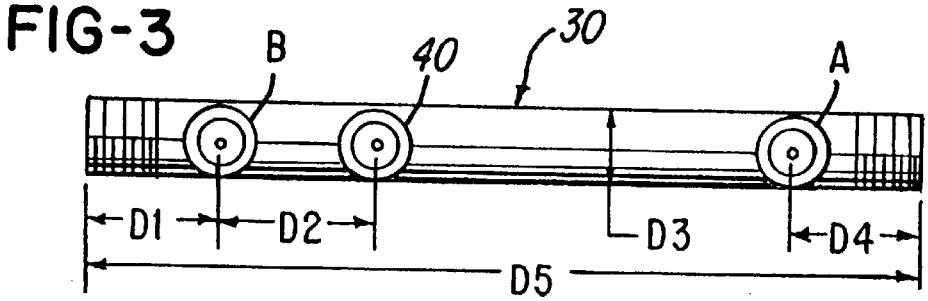
FIG. 3 is a plan view of the venturi shown in FIG. 2.

FIGS. 2 and 3 illustrate various features and measurements of the venturi 30 with the various dimensions at points D1–D16 identified in the following Table III:

TABLE III

| Dimension | Size |
|---|---|
| D1 | 1.5" |
| D2 | 1.71" |
| D3 | 0.84" |
| D4 | 1.5" |
| D5 | 9.5" |
| D6 | 0.622" |
| D7 | 10.5 E |
| D8 | 2.0" |
| D9 | 1.172" |
| D10 | 0.2" |
| D11 | 0.188" |
| D12 | 4.145" |
| D13 | 0.622" |
| D14 | 3 E |
| D15 | ¼" NPIF hole at 3 locations |
| D16 | 0.1" through hole at 3 locations concentric with D15 holes |

It should be appreciated that the values represented in Table III are merely representative for the embodiment being described.

Table IV in FIG. 5 is an illustration of the results of another venturi 30 (not shown) at various flow rates using varying flow rate diameters at the throat 36 (represented by dimension D11 in FIG. 2).

It should be appreciated that by holding the pressure at the throat 36 at the predetermined pressure, which in the embodiment being described is atmospheric pressure, the velocity of the fluid exiting end 34 of venturi 30 can be consistently and accurately determined using the pressure switch 46, rather than a differential pressure switch (now shown) which operates off a differential pressure between the throat 36 and the inlet end 32 or outlet end 34. Instead of using a differential pressure device (not shown) to measure flow in the system, the expansion tank, when attached to the throat 36 of venturi 30, causes the fluid in the system 10 to be at atmospheric pressure when there is zero flow. For any given flow rate, the pressure at the throat 36 of venturi 30 remains at atmospheric pressure, but a fluid velocity is developed for each cross-sectional area in the closed-loop system 10. Since the venturi throat 36 of venturi 30 is smaller than the venturi inlet 32 and the venturi outlet 34, the velocity at the throat will be higher than the velocity at the inlet 32 or outlet 34. This velocity difference creates a pressure difference between the venturi throat 36 and the ends 32 and 34, which mandates that the pressure at the throat 36 be lower than the pressure at the ends 32 and 34. Stated another way, the pressure at the ends 32 and 34 must be higher than the pressure at the throat 36 which is held at atmospheric pressure.

Consequently, the pressure at the ends 32 and 34 must be greater than atmospheric pressure when there is flow in the system 10. This phenomenon causes the overall pressure in the system 10 to increase, which in effect, raises the effective boiling point of the fluid in the system 10. Because the boiling point of the fluid in the system 10 has been raised, this facilitates avoid cavitation in the pump 22 which occurs when the fluid in the system 10 achieves its boiling point.

Another feature of the invention is that because the boiling point of the fluid is effectively raised in the closed-loop system 10, the higher fluid temperature creates a larger temperature differential and enhances heat transfer for a given size heat exchanger 16. In the embodiment being described, the specific volume of vaporized fluid is reduced by an increase in the system pressure. By way of example, water's specific volume is 11.9 $ft.^3$/lbs. at 35 psia and 26.8 $ft.^3$/lbs. at atmospheric pressure. Thus, increasing the system pressure results in a reduction of the specific volume of the vaporized fluid.

In the embodiment being described, the fluid is a liquid such as water, but it may be any suitable fluid cooling medium, such as ethylene glycol and water, oil, water or other heat transfer fluids, such as Syltherm® available from Dow Chemical.

Advantageously, the higher pressure enabled by venturi 30 permits the use of a simple pressure switch 46 to act as a flow switch. This switch 46 could be placed at the venturi outlet 34 (for example, at port A in FIG. 2), as illustrated in FIG. 1, or at the inlet 32 (for example, at port B in FIG. 2).

Note that a single pressure switch whose reference is atmospheric pressure is preferable. Because its pressure is atmospheric pressure, it does not need to be coupled to the throat 36, which is also at atmospheric pressure. Once the pressure is determined at the outlet 34 or inlet 32, a flow rate can be calculated using the formula mentioned earlier herein, thereby eliminating a need for a differential pressure switch of the type used in the past. A method for increasing pressure in the closed-loop system 10 will now be described.

The method comprises the steps of situating the venturi in the closed-loop system 10. In the embodiment being described, the venturi is situated in series in the system 10 as shown.

A predetermined pressure, such as atmospheric pressure in the embodiment being described, is then established at the throat 36 of the venturi 30. The method further uses the pump 22 to cause flow in the system 10 in order to increase pressure in the system, thereby increasing a flow rate of the fluid in the system 10 such that the pressure at the inlet 32 and outlet 34 relative to the throat 36, which is held at a predetermined pressure, such as atmospheric pressure, is caused to be increased.

In the embodiment being described, the predetermined pressure at the throat 36 is established to be the atmospheric pressure, but it should be appreciated that a pressure other than atmospheric pressure may be used, depending on the pressures desired in the system 10. Advantageously, this system and method provides an improved means for cooling a heat-generating component utilizing a simple pressure switch 46 and venturi 30 combination to provide, in effect, a switch for generating a signal when a flow rate achieves a predetermined rate. This signal may be received by ECU 50, and in turn, used to control the operation of heat-generating component 12 to ensure that the heat-generating component 12 does not overheat.

Figure 7:
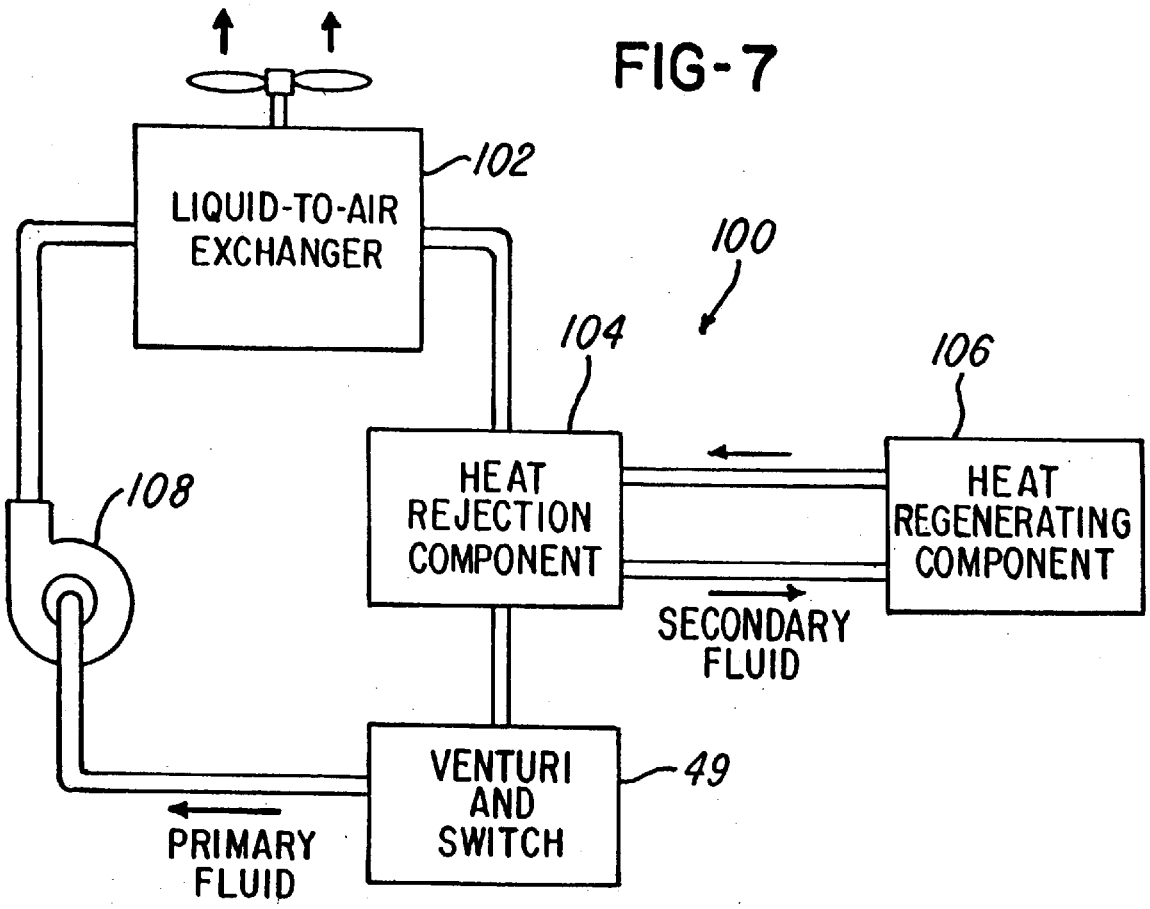
FIG. 7 is a schematic diagram illustrating another embodiment of the invention.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims. For example, while the system 10 has been shown and described for use relative to a X-ray cooling system, it is envisioned that the system may be used with an internal combustion engine, cooling system, a hydronic boiler or any closed loop heat exchanger that uses a fluid to cool another fluid. For example, note in FIG. 7 basic features of Applicant's invention are shown. The system 100 comprises a heat exchanger 102, such as a liquid to air heat exchange, and a liquid-to-liquid heat exchanger 104 for cooling a fluid, such as oil, from a heat-generating component 106. Note that the Venturi 30 and switch 46 configuration (labeled 49 in FIG. 1) are provided upstream of pump 108. Providing the arrangement 49 advantageously enables higher system pressure and higher operating fluid temperatures that maximizes heat transfer capabilities of heat exchangers 102 and/or 104. This design also facilitates bringing system pressure back to atmospheric pressure at substantially the same time as when the flow rate is reduced to zero.

What is claimed is:

1. A method for increasing pressure in a closed-loop system comprising a pump for pumping fluid in said system, a heat-generating component and a heat-rejection component, said method comprising the steps of:

situating a venturi in series with the pump in said closed-loop system; and providing a predetermined pressure at a throat of said venturi in order to raise an internal pressure in said closed-loop system above said predetermined pressure, wherein said internal pressure is greater than said predetermined pressure;

using said pump to cause flow in said closed-loop system in order to increase pressure in said system, thereby increasing said boiling point of the fluid, said overall pressure being greater than said predetermined pressure.

2. The method as recited in claim 1 wherein said predetermined pressure is atmospheric.

3. The method as recited in claim 1 wherein said method further comprises the step of:

situating an expansion tank at said throat.

4. The method as recited in claim 1 wherein said method further comprises the step of:

providing a switch for controlling the operation of said heat-generating component and causing said component to be turned on or off if a flow in said closed-loop system is above or below a predetermined flow rate.

5. The method as recited in claim 4 wherein said method comprises the step of:

situating said switch downstream of said venturi.

6. The method as recited in claim 4 wherein said predetermined pressure remains substantially constant as a rate of said flow changes.

7. The method as recited in claim 6 wherein said predetermined pressure is atmospheric.

8. The method as recited in claim 4 wherein said method comprises the step of:

situating said switch adjacent either an inlet or outlet of said venturi.

9. The method as recited in claim 8 wherein said switch is situated upstream of said pump and downstream of said venturi.

10. The method as recited in claim 1 wherein said heat-generating component comprises an X-ray tube.

11. A cooling system for cooling a component comprising:

a heat-rejection component;

a pump for pumping fluid to said heat-rejection component and said component; and a conduit for providing closed-loop communication of fluid in series to said component, said heat-rejection component and said pump;

said conduit comprising a venturi having a predetermined pressure applied at a throat of said venturi.

12. The cooling system as recited in claim 11 wherein said predetermined pressure is atmospheric pressure.

13. The cooling system as recited in claim 12 wherein said system further comprises a switch situated in said conduit for generating a signal used to control operation of said component when a flow rate of said fluid is not at a predetermined flow rate.

14. The cooling system as recited in claim 13 wherein said switch is located either upstream or downstream of said venturi and upstream of said pump.

15. The cooling system as recited in claim 14 wherein said component comprises an X-ray tube.

16. The cooling system as recited in claim 14 wherein said component comprises an internal combustion engine.

17. The cooling system as recited in claim 14 wherein said component comprises a hydronic boiler.

18. The cooling system as recited in claim 11 wherein said predetermined pressure is provided by an expansion tank in communication with a throat of said venturi.

19. The cooling system as recited in claim 18 wherein said expansion tank comprises a diaphragm having one side in communication with said fluid and an opposite side subject to atmospheric pressure.

20. The cooling system as recited in claim 11 wherein said system further comprises a switch situated in said conduit for generating a signal used to control operation of said component when a flow rate of said fluid is not at a predetermined flow rate.

21. The cooling system as recited in claim 20 wherein said switch is a pressure switch measures fluid pressure relative to atmospheric pressure.

22. The cooling system as recited in claim 21 wherein said switch is located downstream of said venturi and upstream of said pump.

23. The cooling system as recited in claim 22 wherein said component comprises an X-ray tube.

24. The cooling system as recited in claim 20 wherein said switch is located upstream of said pump.

25. An X-ray system comprising:

an X-ray apparatus for generating X-rays, said X-ray apparatus comprising an X-ray tube situated in an X-ray tube casing; and a closed-loop cooling system for cooling said X-ray tube, said cooling system comprising:

a heat-rejection component coupled to said X-ray tube casing;

a pump for pumping fluid to said heat-rejection component and said x-ray tube casing;

a conduit for communicating fluid in series among said X-ray tube casing, said heat-rejection component and said pump;

said conduit comprising a venturi having a predetermined pressure applied at a throat of said venturi.

26. The X-ray system as recited in claim 25 wherein said predetermined pressure is atmospheric pressure.

27. The X-ray system as recited in claim 26 wherein said system further comprises a switch situated in said conduit for generating a signal used to control operation of said x-ray tube when a flow of said fluid is not at a predetermined flow rate.

28. The X-ray system as recited in claim 27 wherein said switch is located either upstream or downstream of said venturi and upstream of said pump.

29. The X-ray system as recited in claim 27 wherein said switch is located downstream of said venturi and upstream of said pump.

30. The X-ray system as recited in claim 25 wherein said predetermined pressure is provided by an expansion tank in communication with a throat of said venturi.

31. The X-ray system as recited in claim 30 wherein said expansion tank comprises a diaphragm having one side in communication with said fluid and an opposite side subject to atmospheric pressure.

32. The X-ray system as recited in claim 25 wherein said system further comprises a switch situated in said conduit for generating a signal used to control operation of said x-ray tube when a flow of said fluid is not a predetermined flow rate.

33. The X-ray system as recited in claim 32 wherein said switch is a pressure switch that measures fluid pressure relative to atmospheric pressure.

34. The X-ray system as recited in claim 33 wherein said predetermined pressure equals atmospheric pressure.

35. The X-ray system as recited in claim 32 wherein said switch is located downstream or upstream of said venturi and upstream of said pump.

36. The X-ray system as recited in claim 32 wherein said predetermined pressure equals atmospheric pressure.

37. A method for cooling a component situated in a system, said method comprising the steps of:

providing a conduit coupled to said component;

coupling said component to a pump for pumping a cooling fluid through said conduit and to a heat-rejection component;

increasing a boiling point of said cooling fluid, thereby increasing an operating temperature of said X-ray system;

wherein said method further comprises the steps of:

providing a venturi having a throat in said conduit in order to increase said overall pressure;

holding a throat pressure at the throat of said venturi to a predetermined pressure.

38. The method as recited in claim 37 wherein said predetermined pressure is atmospheric pressure.

39. The method as recited in claim 38 wherein said method further comprises the step of situating an expansion tank in communication with a throat of said venturi.

40. The method as recited in claim 39 wherein said expansion tank comprises a diaphragm having one side in communication with said fluid and an opposite side subject to atmospheric pressure.

41. The method as recited in claim 39 wherein said method further comprises the step of:

providing a switch for causing power to said component to be terminated when a flow rate in said conduit is less than a minimum flow rate.

42. The method as recited in claim 41 wherein said switch is a pressure switch.

43. The method as recited in claim 42 wherein said switch is located either upstream or downstream of said venturi and upstream of said pump.

44. The method as recited in claim 41 wherein said switch is located downstream of said venturi and upstream of said pump.

45. The method as recited in claim 41 wherein when said minimum flow rate is about zero, the pressure in the system goes to atmospheric at substantially the same time.

46. The method as recited in claim 37 wherein said method further comprises the step of:

terminating power to said component when a flow of said fluid is less than a minimum flow rate.

47. The method as recited in claim 46 wherein said minimum flow rate is less than about 1 GPM when a velocity of said fluid at the throat of said venturi is at least 16 Ft./Sec.

48. The method as recited in claim 47 wherein said component comprises an X-ray tube.

49. The method as recited in claim 37 wherein said method further comprises a switch situated in said conduit for generating a signal used to terminate operation of said component when a flow rate of said fluid is less than a predetermined flow rate.

50. The method as recited in claim 37 wherein said component comprises an X-ray tube.

* * * * *